United States Patent [19]

Olasz et al.

[11] Patent Number: 4,483,266

[45] Date of Patent: Nov. 20, 1984

[54] SEWING MACHINE WITH SELECTIVELY CONTROLLED CONVEYOR BELT FEED

[75] Inventors: Sándor Olasz; Dénes Szalay; József Kovács; Olivér Kocsis, all of Budapest, Hungary

[73] Assignee: Csepel Muvek Jarmu Es Konfekcioipari Gepgyara, Budapest, Hungary

[21] Appl. No.: 265,081

[22] Filed: May 19, 1981

[30] Foreign Application Priority Data

May 29, 1980 [HU] Hungary ..... 1349/80

[51] Int. Cl.[3] ..... D05B 27/00

[52] U.S. Cl. ..... 112/304; 112/121.11; 198/859

[58] Field of Search ..... 112/304, 121.11, 121.12, 112/121.15, 121.22, 121.27, 314; 198/341, 345, 460, 858, 859, 856

[56] References Cited

U.S. PATENT DOCUMENTS

| | | | |
|---|---|---|---|
| 3,025,444 | 3/1962 | Myska | 112/121.11 X |
| 3,469,545 | 9/1969 | Hale et al. | 112/304 X |
| 3,583,341 | 6/1971 | Birdsong | 112/304 X |
| 3,589,320 | 6/1971 | Beazley | 112/304 X |
| 3,800,719 | 4/1974 | Rockerath . | |
| 3,841,462 | 10/1974 | Schmidt | 198/345 |
| 3,861,338 | 1/1975 | Galya . | |
| 3,871,312 | 3/1975 | Rockerath . | |
| 4,107,592 | 8/1978 | Bayer | 112/121.11 X |
| 4,231,465 | 11/1980 | Bourgeois | 198/460 |
| 4,327,653 | 5/1982 | Blessing | 112/304 X |

FOREIGN PATENT DOCUMENTS

| | | | |
|---|---|---|---|
| 1485277 | 7/1972 | Fed. Rep. of Germany . | |
| 2036068 | 3/1975 | Fed. Rep. of Germany . | |
| 196604 | 5/1967 | U.S.S.R. | 198/856 |
| 206385 | 2/1980 | U.S.S.R. | 198/856 |

*Primary Examiner*—Werner H. Schroeder
*Assistant Examiner*—Andrew M. Falik
*Attorney, Agent, or Firm*—Young & Thompson

[57] ABSTRACT

A sewing machine having a power-driven needle has an endless feed belt for moving workpieces beneath the needle. The belt stops and advances, and there is provision for measuring the movement of the belt upon each advance of the belt. In response to this measurement, the belt is stopped, thereby to ensure that the belt moves only a predetermined distance beneath the needle each time the belt advances. To advance the belt, there is a friction roll in contact with the belt, a back-up roller on the opposite side of the belt from the friction roll, and structure selectively to apply the back-up roll forcibly against the belt and to move the back-up roll away from the belt, thereby respectively to drive the belt and to interrupt the drive to the belt. The measuring structure is a wheel that rotates in frictional contact with the belt, the wheel including a transparent plate having radial scale markings thereon, a stationary transparent ruled interference grating has parallel markings thereon that overlie the markings on the transparent plate. A light source transilluminates both the grating and the transparent plate, and photoelectric cells on the other side of the plate and grating from the light source detect interference fringes and generate a signal responsive to the detection of the interference fringes, which signal is indicative of the distance the belt travels. The starting and stopping of the belt are controlled according to this signal.

7 Claims, 6 Drawing Figures

SEWING MACHINE WITH SELECTIVELY CONTROLLED CONVEYOR BELT FEED

Figure 1:
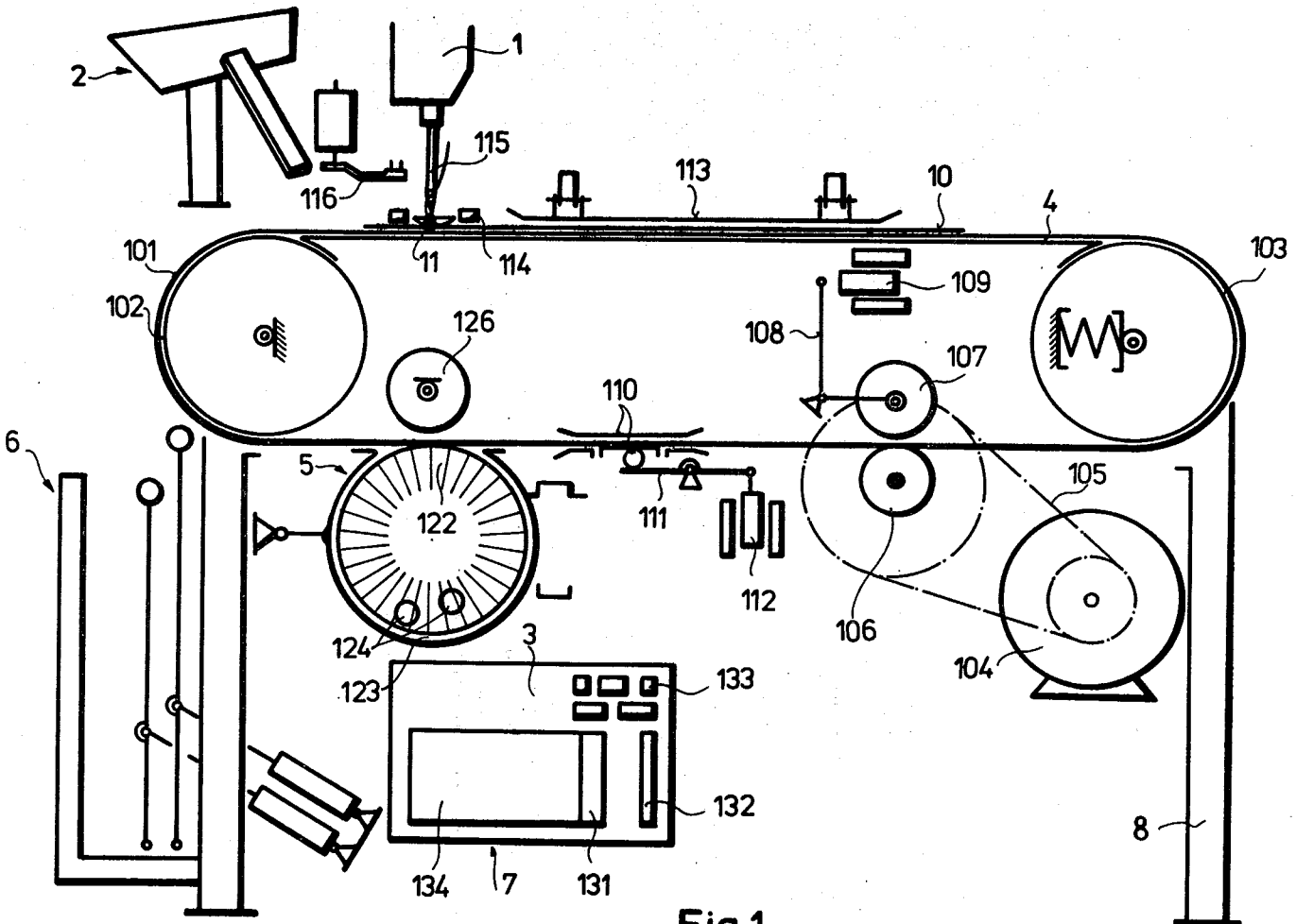

The invention relates to a feed belt operated sewing machine and control unit.

Such a sewing machine is an apparatus which produces seams automatically on work pieces in series, in which the work pieces are moved with an endless belt.

Such a machine is known, in which the work piece is fed with a stepping shoe. Upon finishing the seam, the shoe settles on the work piece and slides it a fixed distance, then at commencement of the seam it rises and returns to its original position in order to repeat the stepping when the seam is completed. This process is repeated according to the number of seams to be produced.

The disadvantage of this solution is, that at the end of the feeding the stepping shoe releases the work piece and at the next feeding it is gripped again, but meanwhile the work piece may slip, resulting in inaccuracy in the distance and position of the seams. The length of feeding is adjusted with a stop device, the drawback of which is, that the adjustment inaccuracies are additive. A further drawback is that the extent of the steps is always the same, hence no work piece can be produced on which—for instance for decorative purpose—the distance between the seams is either greater or less.

Such an apparatus is also known, in which the work pieces are clamped in a clip at the end of the table moving in a straight guide and the work piece is carried along by the table according to preset stops or sensors. The table may be moved with a belt wound up on a drum, the winding being controlled, or with the aid of a screw spindle, where the turn of the screw spindle is controlled as a function of the positioning. There is such an apparatus, in which an endless belt travels at a constant speed and according to the direction of feeding the table is engaged alternately to one or the other side, thus it moves forwards and backwards. When the seam is finished, the table carries the work pieces to the place of the next seam and when the last seam is finished, it returns to its initial position.

The drawback of the described machine is that for the feeding of the work pieces the table has to be moved with the work pieces. The table is relatively heavy, thus its starting and stopping require that it have a strong construction, and its positioning requires intensive braking and absorption of the kinetic energy. A further drawback is that upon completion of the work cycle the table has to return to its initial position, whereby the work process is slowed down. Another drawback is that movement of the feeding table needs as much space along the section after the sewing machine as before. From this it follows, that the structural length of the feeding apparatus is great, consequently the space requirement of the apparatus is significant.

The invention is aimed at the simultaneous elimination of the above difficulties and the realization of such a sewing machine, which completely meets the complex requirements for the automatic production of seams in series at optional distance, easy and versatile controllability and the need for only small space.

Accordingly, the problem to be solved with the invention is to provide a seam producing machine with a feed belt, which produces seams in series at optional distance from each other, that is easily controlled and has only a small space requirement.

The invention is based on the recognition, that the problem is solved in a simple way by supplementing the sewing machine with an intermittently moved endless belt controlled externally.

The novelty of the invention, i.e. the further development comprises having a feeding table for the work pieces connected to the sewing machine, an endless feed belt for moving the work piece on the feeding table, a shoe fastening the work piece onto the feed belt, as well as a braking and clamping unit, a unit for measuring the movement of the feed belt and a control gear the input of which is connected to the measuring unit, while the output is connected to the control unit of the sewing machine.

Figure 2:
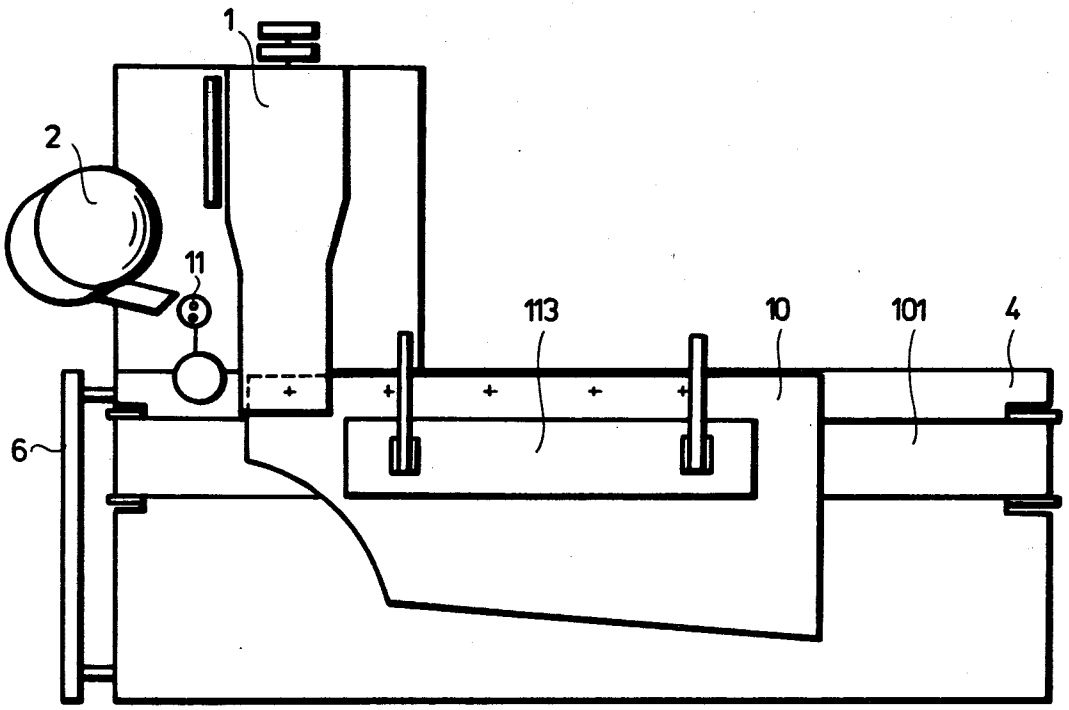
Figure 3:
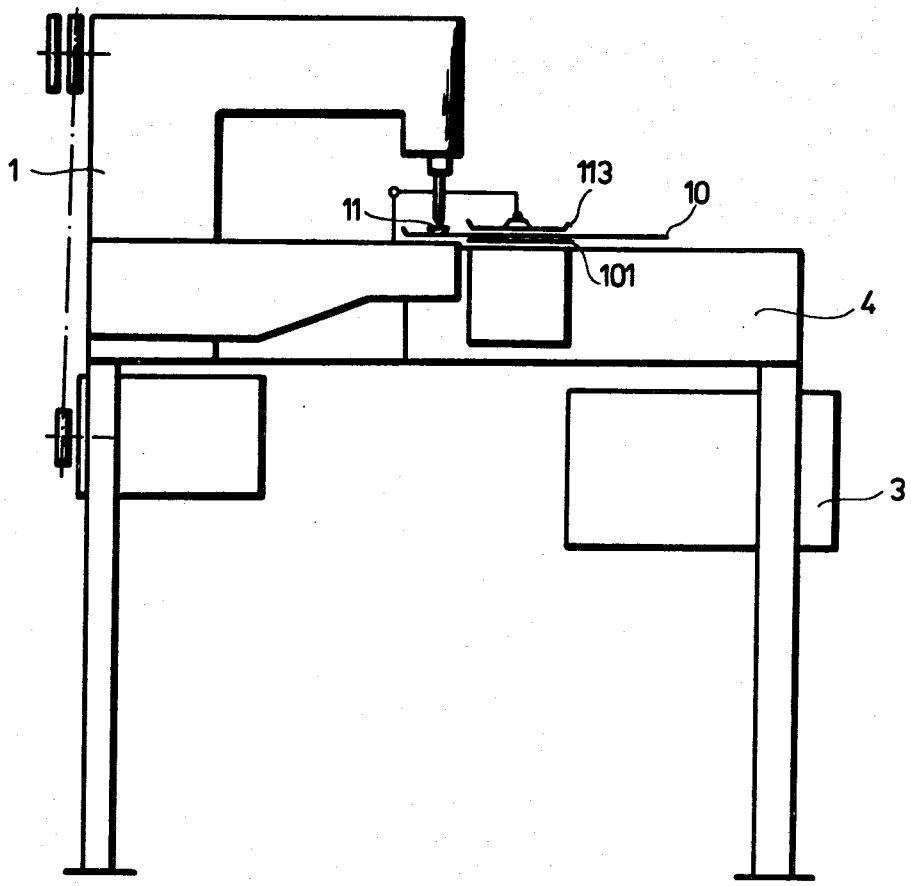

The invention is described in detail by way of example, with the aid of the accompanying drawings, in which:

FIG. 1: Schematic arrangement of the sewing machine with feed belt according to the invention, FIG. 2: Diagrammatic plan view of the sewing machine with feed belt according to the invention, FIG. 3: Diagrammatic side view of the embodiment according to FIG. 2, FIG. 4: Detail of the schematic arrangement according to FIG. 1, namely, a view showing the schematic arrangement of the device measuring the feeding, FIG. 5: Detail of the schematic arrangement according to FIG. 4, namely, a view showing the reading part with the interference fringes shown on a relatively larger scale, FIG. 6: Detail of the schematic arrangement according to FIG. 1, namely, a view showing the schematic arrangement of the control unit.

In FIG. 1 the schematic diagram of the sewing machine with feed belt is shown by way of example as a button sewing machine 1 having a conventional button feeder 2, control unit 3, loading unit 6, machine frame 8, to sew buttons 11 on a work piece 10.

Endless feed belt 101 is arranged on the feeding table 4, the side of which bearing upon the feeding table 4 is readily slidable since it has an anti-friction surface, while the other side in contact with the work piece 10 is adhesive for feeding the work piece 10 without slippage. The feed belt 101 is guided along the two edges of the feeding table 4 with the aid of rollers 102 and 103. The roller 103 is spring loaded, as a result of which the feed belt 101 is constantly tight.

For operation of the sewing machine according to the invention the intermittent movement of the feed belt 101 and its securement after positioning are necessary. The former is solved by driving a friction roll 106 from a constantly revolving motor 104 with the aid of gearing, said friction roll being in contact with the feed belt 101. A supporting roller 107 is on the other side of the feed belt 101 and the axes of rolls 106 and 107 lie in a plane perpendicular to the feed belt. Roller 107 is moved toward and away from roll 106 through a two-armed lever 108 with a solenoid 109.

Fixing of the feed belt 101 is ensured by a brake device. The brake shoes 110 arranged on both sides of the feed belt 101 are displaceable against each other through the brake solenoid 112 connected with the two-armed lever 111.

For better fastening of the work piece 10 on the feed belt 101, the work piece 10 is pressed with shoe 113 to the feed belt 101 (FIG. 2), thus the work piece 10 cannot slip on the adhesive surface of the feed belt 101. This is facilitated also by the anti-friction surface (e.g. chromium plated or Teflon coated) of the shoe 113 facing the work piece 10.

Figure 5:
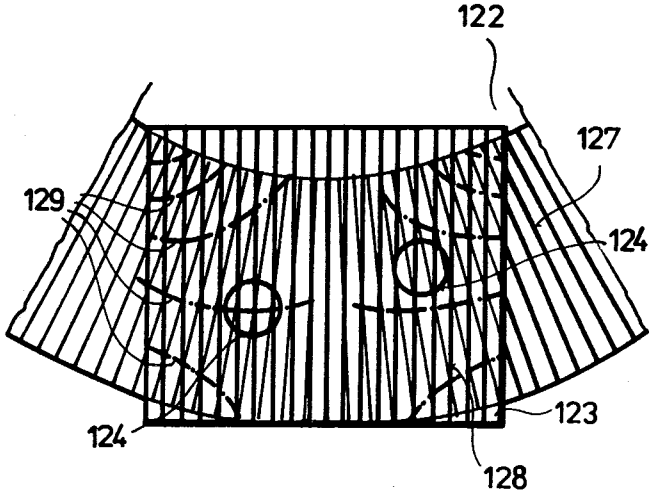
Figure 4:
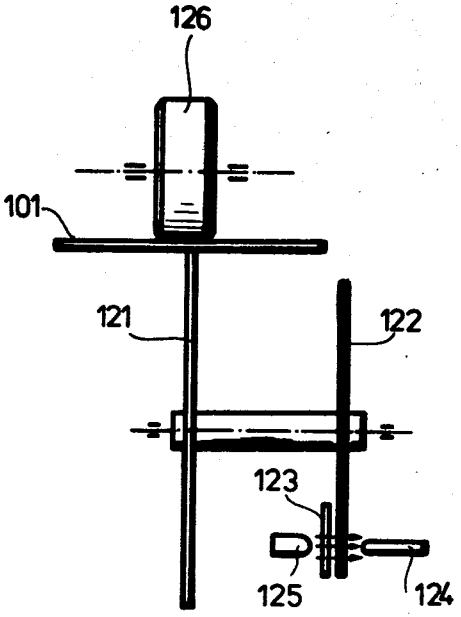

The distance between two adjacent seams (in this case two adjacent buttons 11) is determined by each movement of the feed belt 101. For sensing this movement a measuring unit 5 (FIG. 1) is connected to the feed belt 101. For this purpose, a spur wheel 121 is pressed against the feed belt 101 and against the supporting roller 126 in such a way, that the spur wheel 121 rolls along the feed belt 101 without slipping (FIG. 4). A counter plate 122 is in rigid uniaxial connection with the spur wheel 121 and it is made of transparent material and its diameter is less than that of the spur wheel 121. There are scale divisions 127 in radial direction starting from the edge of the counter plate 122 (FIG. 5). The diameter of the spur wheel 121 is suitably such and there is such a number of scale divisions 127 on the counter plate 122, that the unit movement of the feed belt 101 corresponds to the counter plate turning by a whole number of the scale divisions 127. In this embodiment the diameter of the spur wheel 121 is 57.296 mm, and the counter plate 122 has 360 scale divisions, i.e. one scale division 127 per degree. Thus each 2° turn of the counter plate 122 corresponds to 1 mm movement of the feed belt 101. An interference grating 123 is fixed in parallel with the counter plate 122, the parallel rulings 128 on it being such, that interference fringes 129 are brought about with the scale divisions 127 on the counter plate 122. These interference fringes 129 move as a result of the turning of the counter plate 122 in such a way, that owing to the counter plate turning a half scale division 127 (half a degree), the light interference fringe 129 becomes dark at a given place and vice versa. There are two photo diodes 124 near the counter plate 122 facing the counter plate and the scale divisions 127 in such a way, that one of the photo diodes 124 "sees" light, while the other one sees dark interference fringes 129. There is a light source 125 arranged opposite each photo diode 124 (FIG. 4), the rays of light emitted from it transilluminate the ruled grating 123 and the counter plate 122 and pass into the corresponding photo diodes 124.

The task of the spur wheel 121 and counter plate 122 can be performed by a single disc, but in this case a suitable diameter, anti-slip connection to the feed belt 101 and scale divisions 127 in adequate number and arrangement have to be provided for the same disc. In order to simplify the construction, an arrangement with separate spur wheel 121 and separate counter plate 122 was selected.

The sewing machine should have a suitable control. We prefer to produce seams of optional stitch number and at optional distance from each other, thus the control has to monitor the movement of the feed belt 101. It should emit the intervention signal after a specific movement, and allow variable movement (the intervention signal is to be programmable). Its further task is the elimination of inaccuracies arising from the slippage of the feed belt 101 and from the inertia mass of the moving parts. The control is connected suitably to the already existing control of the sewing machines.

Figure 6:
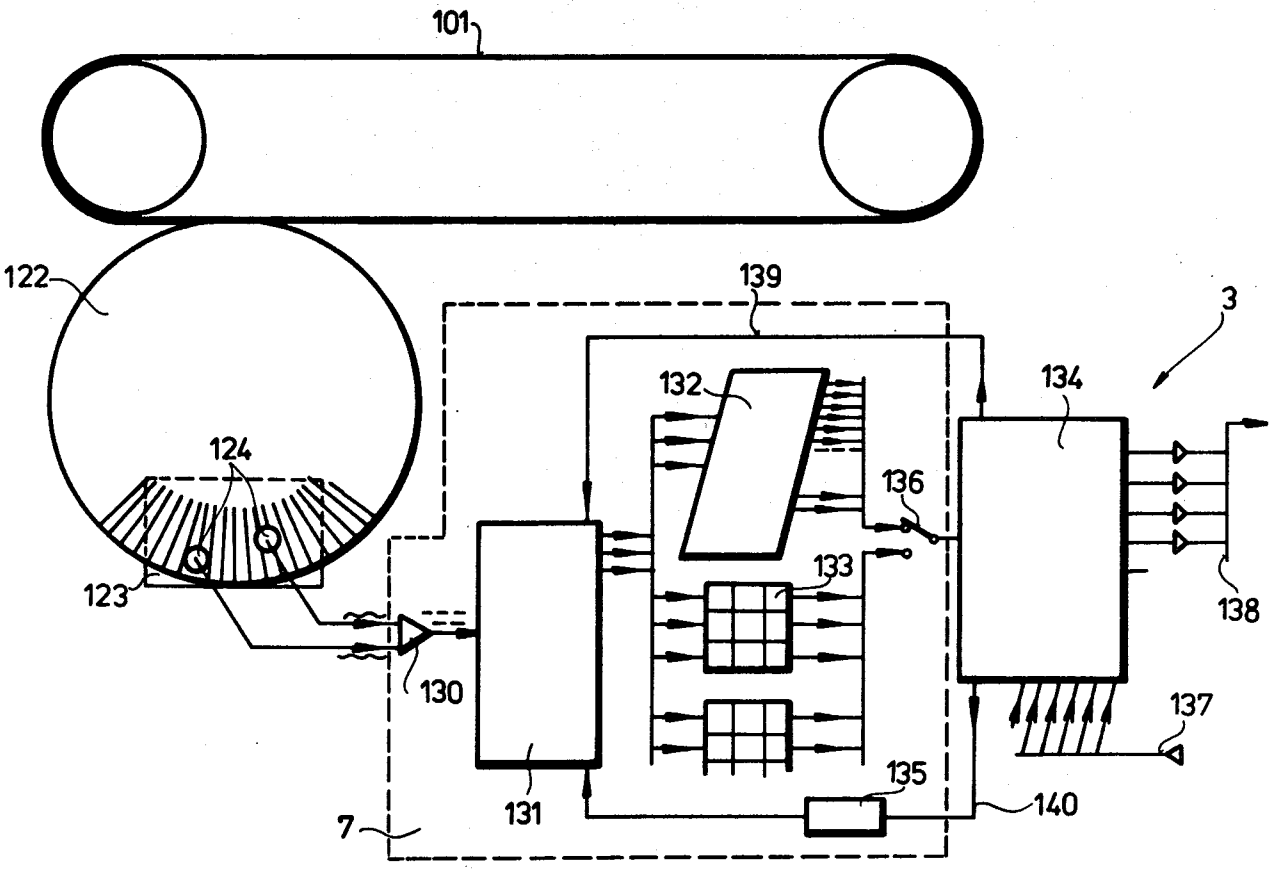

In accordance with the above, the existing control unit 3 of the sewing machine 1 (surrounded with dashed line in FIG. 6) is supplemented with a control 7. The signals from the photo diode 124 of the measuring unit 5 are transmitted to the input of the control 7. These signals in the control 7 pass to the analog-digital converter 130, whence the digital signals are transmitted to the counter storage unit 131. From here the signals pass to the logical unit 134 existing in the control unit 3 of the sewing machine 1. Its program however is determined with the program card 132 in the control 7 or with the aid of the spur wheel value adjusters 133. Selection between the program card 132 and spur wheel value adjusters 133 is taken care of by building in a change-over switch 136. The logical unit 134 with feedback is in direct connection and with feedback 140 it is in indirect connection with the counter storage unit 131 through signal generator 135. The control unit 3 transmits instructions—on the basis of the signals arriving from the control 7 and from the existing sensors 137 of the sewing machine 1—through the actuator outputs for the respective units of the seam producing machine (FIG. 6).

The sewing machine with feed belt according to the invention functions as follows:

The apparatus is in starting position when switched on. The needle 115 and button clamp 114 of the sewing machine 1 and the shoe 113 are in raised position, the brake shoes 110 are applied, i.e. the brake solenoid 112 is in pulled-in position. The motor 104 and with it the friction roll 106 revolve, but the supporting roller 107 is not pressed to the feed belt 101, i.e. the starting solenoid 109 is not pulled in, thus the feed belt 101 is stationary. The counting train in the counter storage unit 131 is set to 0.

The necessary data are programmed on the spur wheel value adjuster 133 (number of buttons, distance, stitch number, etc.), or the program card 132 corresponding to the required program is inserted and the changeover switch 136 is set accordingly. (In case of another embodiment the changeover switch 136 may be on the program card 132, when the switching over takes place simultaneously with its insertion.) The work pieces 10 are placed on the feeding table 4 and on the feed belt 101, then the starting button is pressed. From here on everything is automatic. The shoe 113 is lowered and it clamps the work piece 10, the button clamp 114 places the button 11 under the needle 115 and the sewing begins. At the end of the sewing the button clamp 114 rises and the button feeder 2 passes a new button 11 into the button clamp 114 with the aid of the button feeding arm 116. All these processes are controlled by the existing control unit of the sewing machine 1.

After rise of the button clamp 114 the feed belt 101 starts by the brake solenoid 112 being released and at the same time the starting solenoid 109 pulls in, i.e. the brake shoes 110 separate from the feed belt 101, while the supporting roller 107 is pressed against belt 101. The feed belt 101 brings into motion the spur wheel 121 engaged without slippage and thereby the counter plate 122, as a result of which the interference fringes 129 move away. Thus the photo diodes 124 see alternately dark and light, but in a push-pull circuit, i.e. when one of the photo diodes 124 sees light, then the other one sees dark and vice versa. Thus a push-pull sinusoidal signal is formed on the output of photo diodes 124, which is converted by the analog-digital converter 130 to digital signals, which are added and stored by the counter storage unit 131 according to the current position of the work piece 10 during the work cycle. The signals coming from the counter storage unit 131 pass into the logical unit 134 according to the programming of the spur wheel value adjuster 133 (according to the position of the changeover switch 136). Also the signals from the other existing sensors 137 of the sewing machine are received here and from here will initiate the signals actuating the respective units through the output of the actuator 138.

The signal generator 135 in feedback 140 serves for filtering out the inaccuracies arising from the slippage of the feed belt 101 and from the inertia of the mass in motion. After starting up, the feed belt 101 generates and passes some false signals through the feedback 140 into the counter storage unit 131 as if the counter plate 122 were turned off by as many scale divisions. This way the counter storage unit 131 reaches the programmed value sooner than would correspond to the real turning of the counter plate 122, but feed belt 101 does not stop immediately with the braking pulse, but moves somewhat farther. However as a result of the braking pulse emitted earlier by the signal generator 135, the feed belt 101 will come to a stop exactly at the place of the next seam, or button 11.

In this way it is ensured, that the feed belt 101 stops exactly at the predetermined place, wherein the above described process of the button sewing starts off right from the beginning. At the end of the work cycle the logical unit 134 resets the counting train through the feedback to 0, and thereby commencement of a new work cycle becomes possible.

In view of above it will be obvious for the expert, that the sewing machine with feed belt is readily connectible to any type of sewing machine and that it is suitable not only for the automation of button sewing but also for seam production, and that the extensive programming possibility makes it suitable for performing the most diversified tasks.

What we claim is:

1. In a sewing machine having a power-driven needle and an endless feed belt for moving workpieces beneath the needle; the improvement comprising means alternately to stop and advance the belt, means for measuring the movement of the belt during each advance of the belt, means responsive to said measuring means to actuate said belt stopping means thereby to ensure that the belt moves only a predetermined distance beneath said needle each time the belt advances, and means to drive the needle and the belt independently of each other whereby the needle can operate when the belt is stopped.

2. A sewing machine as claimed in claim 1, said advancing means comprising a friction roll in contact with the feed belt, a back-up roller on the opposite side of the belt from the friction roll, and means selectively to apply the back-up roller forcibly against the belt and to move the back-up roller away from the belt, thereby respectively to drive the belt and to interrupt the drive to the belt.

3. A sewing machine as claimed in claim 2, in which said means to apply the back-up roller comprises a solenoid.

4. A sewing machine as claimed in claim 1, said means to stop the belt comprising brake shoes movable toward and away from each other and disposed on opposite sides of the belt.

5. A sewing machine as claimed in claim 4, and a solenoid for moving said brake shoes toward and away from each other.

6. A sewing machine as claimed in claim 4, said measuring means comprising wheel means that rotate in frictional contact with the belt, said wheel means including a transparent plate having radial scale markings thereon, a stationary transparent ruled interference grating having parallel markings thereon overlying said markings of said transparent plate, a light source transilluminating both said grating and said transparent plate, photoelectric means on the other side of the plate and grating from the light source to detect interference fringes and to generate a signal responsive to the detection of said interference fringes which signal is indicative of the distance the belt travels, and means to control said stopping and advancing means according to said signal.

7. A sewing machine as claimed in claim 6, said photoelectric means comprising two photoelectric cells and said light source comprising a light source individual to each of said cells, the arrangement of the markings on the transparent grating and transparent plate being such that one said cell sees a light interference fringe at the same time that the other said cell sees a dark interference fringe.

* * * * *